US009814281B2

(12) United States Patent
Fisher et al.

(10) Patent No.: US 9,814,281 B2
(45) Date of Patent: Nov. 14, 2017

(54) COMBINATION SHOELACE AND HOOK AND LOOP FASTENERS SHOE TIGHTENING SYSTEM WITH REPLACEABLE SHOELACES

(71) Applicant: Bell Sports, Inc., Scotts Valley, CA (US)

(72) Inventors: Simon Fisher, Santa Cruz, CA (US); Steven D. Swartzendruber, Santa Cruz, CA (US); Eric Horton, Aptos, CA (US); Ahadin Maryo Hutasoit, Aptos, CA (US); Michael Friton, Portland, OR (US); Michael J. Musal, Soquel, CA (US); Scott Junker, Santa Cruz, CA (US)

(73) Assignee: BELL SPORTS, INC., Scotts Valley, CA (US)

( * ) Notice: Subject to any disclaimer, the term of this patent is extended or adjusted under 35 U.S.C. 154(b) by 0 days.

(21) Appl. No.: 15/429,862

(22) Filed: Feb. 10, 2017

(65) Prior Publication Data

US 2017/0231326 A1 Aug. 17, 2017

Related U.S. Application Data

(60) Provisional application No. 62/294,300, filed on Feb. 12, 2016.

(51) Int. Cl.

| | |
|---|---|
| ***A43C 11/00*** | (2006.01) |
| ***A43C 1/00*** | (2006.01) |
| ***A43C 5/00*** | (2006.01) |
| ***A43C 7/00*** | (2006.01) |
| ***A43C 9/06*** | (2006.01) |
| ***A43C 11/14*** | (2006.01) |

(52) U.S. Cl.
CPC ..... *A43C 11/008* (2013.01); *A43C 1/003* (2013.01); *A43C 5/00* (2013.01); *A43C 7/00* (2013.01); *A43C 9/06* (2013.01); *A43C 11/1493* (2013.01)

(58) Field of Classification Search
CPC ..... A43C 7/00; A43C 1/003; A43C 11/008; A43C 11/1493; Y10T 24/3724; Y10T 24/3705; Y10T 24/3703
USPC ..... 36/50.1
See application file for complete search history.

(56) References Cited

U.S. PATENT DOCUMENTS 2,266,083 A * 12/1941 Rzepa ..... A43C 11/22 24/267
4,081,916 A 4/1978 Salisbury
(Continued)

FOREIGN PATENT DOCUMENTS

DE 202006000986 4/2006

OTHER PUBLICATIONS http://www.amazon.com/ASO-Speed-Lacer-Black-Medium/dp/B002S65NEW.

*Primary Examiner* — Ted Kavanaugh
(74) *Attorney, Agent, or Firm* — Booth Udall Fuller, PLC

(57) ABSTRACT

A shoe quick tightening system includes two shoelace segments with aglets at the ends threaded through openings on the shoe, a pull-tab is connected to an aglet clip with at least two aglet channels to receive the two shoelace segments and aglets, and a clip cover engaged with the clip and enclosing the aglets within the clip and cover, the pull tab including hook and loop fastener portion adapted to couple with a mating hook and loop fastener portion on a surface of the shoe.

30 Claims, 10 Drawing Sheets

(56) References Cited

U.S. PATENT DOCUMENTS

| | | | | | |
|---|---|---|---|---|---|
| 4,102,019 | A * | 7/1978 | Boden | A43C 7/00 | 24/136 R |
| 4,414,761 | A | 11/1983 | Mahood | | |
| 5,027,482 | A | 7/1991 | Torppey | | |
| 5,345,697 | A * | 9/1994 | Quellais | A43B 11/00 | 24/712 |
| 5,353,483 | A | 10/1994 | Louviere | | |
| 5,471,713 | A * | 12/1995 | Alter | A43C 7/00 | 24/136 R |
| 5,894,640 | A * | 4/1999 | Dewey | A43C 11/00 | 24/306 |
| 5,907,912 | A | 6/1999 | Alaimo | | |
| 6,658,765 | B2 * | 12/2003 | Liu | A43C 11/008 | 24/712 |
| 6,941,683 | B2 | 9/2005 | Freed | | |
| 7,574,779 | B2 * | 8/2009 | Takahashi | F16G 11/101 | 24/136 L |
| 8,371,004 | B2 * | 2/2013 | Huber | A43B 5/0401 | 24/132 R |
| 9,526,300 | B2 * | 12/2016 | Krengel | | |
| 2002/0020046 | A1 * | 2/2002 | Voughlohn | A43C 1/00 | 24/712.1 |
| 2004/0158958 | A1 * | 8/2004 | Chang | A43C 7/00 | 24/712.4 |
| 2008/0148538 | A1 * | 6/2008 | Iten | A43C 9/04 | 24/715.4 |

* cited by examiner

COMBINATION SHOELACE AND HOOK AND LOOP FASTENERS SHOE TIGHTENING SYSTEM WITH REPLACEABLE SHOELACES

RELATED APPLICATIONS

This application is based on, claims priority to, and incorporates herein by reference in its entirety, U.S. Provisional Patent Application Ser. No. 62/294,300, filed on Feb. 12, 2016, and entitled "Combination Shoelace and Hook and Loop Fasteners Shoe Tightening System with Replaceable Shoelaces."

TECHNICAL FIELD

Aspects of this document relate generally to shoelace tightening systems, and more specifically to a quick shoe tightening system that allow a wearer to replace shoelaces.

BACKGROUND

Shoes are often tightened one of the two ways, by tying shoelaces or by hook-and-loop fastener straps. Hoop-and-loop fastener straps allow a user to tighten the shoe to various levels of tightness very quickly, but do not provide the flexibility of a shoelace once coupled. On the other hand, shoelaces typically take time to adjust to correct tightness and then tie. Further, hook-and-loop fastener straps usually do not allow a user to replace the straps when a strap is worn or torn, or become undesirable. Combination shoelace and hook-and-loop fastener strap designs exist, but the laces are generally more rigid cords and there is no way to replace the cord/laces when it becomes worn.

SUMMARY

According to one aspect, a quick tightening system for a shoe having a tongue opening, a tongue positioned at the tongue opening, and a first side and a second side divided by the tongue opening, each of the first side and the second side at least partially covering the tongue and including eyelets on portions of the first side and the second side that cover the tongue, the quick tightening system may comprise at least two shoelace segments each comprising an aglet at a distal end of the shoelace segment, each of the two shoelace segments coupled to the first side of the shoe at a proximal end of the shoelace segment and extending through the eyelets on the first side of the shoe, a pull-tab comprising an elongated substrate coupled at a first end to an aglet clip comprising at least two aglet channels each having a separate aglet opening into the aglet clip wherein the aglet channels each separately enter the aglet clip on a first side of the aglet clip and turn toward a side of the aglet clip different from the first side of the aglet clip, the pull-tab further comprising a clip cover slidably engaged with the at least two shoelace segments and slidable from an open position on the at least two shoelace segments to a closed position wherein the aglet cover engages and covers the two aglet channels of the aglet clip, wherein each of the aglets of the at least two shoelace segments is removably coupled into one of the two aglet channels while the at least two shoelace segments extend from the aglet channels into the eyelets on the first side of the shoe, the pull-tab further comprising a first side of a hook-and-loop fastener on a bottom surface of the elongated substrate of the pull-tab, and a second side of the hook-and-loop fastener on an outer surface of the second side of the shoe.

Particular embodiments may comprise one or more of the following features. The aglet channels may be separate. The aglet channels may be parallel to each other. The pull-tab comprises at least one of a protrusion and a depression on the clip cover and at least one of a complementary depression for the protrusion and a complementary protrusion for the depression on the aglet clip engaging with each other at the close position and disengaged from each other at the open position. At at least one channel wall separating the aglet channels. At least two channel walls bordering the at least two aglet channels, wherein each of the at least two channel walls comprises at least one aglet choke extending inward of the at least two channel walls in proximity to each of the aglet openings. The at least two channel walls may comprise at least one retention clip extending above the at least two aglet channels, each retention clip of the at least one retention clip at least partially covering at least one of the at least two aglet channels. The at least one aglet choke may comprise an aglet choke arm extending from a first side of the aglet opening toward a second side of the aglet opening, and extending away from the aglet opening into the aglet channel, the aglet choke arm being fixedly coupled to the first side of the aglet opening and resiliently movable from a rest position to an open position closer to the first side of the aglet opening than in the rest position. The at least two shoelace segments extend across the tongue and the tongue opening once between passing through the eyelets on the first side of the shoe and passing through the eyelets on the second side of the shoe. The at least two shoelace segments are joined with one another between the eyelets on the second side of the shoe after extending through the eyelets on the second side of the shoe. The at least two channel walls may comprise at least one retention clip extending above the at least two aglet channels, each retention clip of the at least one retention clip at least partially covering at least one of the at least two aglet channels. A first strand of the at least two shoelace segments, after passing through a first one of the eyelets on the second side of the shoe, further extends across the tongue and the tongue opening and through a third eyelet on the first side of the shoe, extends across the tongue and the tongue opening and through a third eyelet on the second side of the shoe, and then is joined with other strands of the at least two shoelace segments at a proximity of the third eyelet on the second side of the shoe. At least two channel walls bordering the at least two aglet channels, wherein each of the at least two channel walls comprises at least one aglet choke extending inward of the at least two channel walls in proximity to each of the aglet openings. The at least two channel walls comprise at least one retention clip extending above the at least two aglet channels, each retention clip of the at least one retention clip at least partially covering at least one of the at least two aglet channels. A first strand of the at least two shoelace segments, after passing through a first one of the eyelets on the second side of the shoe, further passes through a third eyelet on the second side of the shoe, extends across the tongue and the tongue opening and through a third eyelet on the first side of the shoe, and then extends across the tongue and the tongue opening and is joined with other strands of the at least two shoelace segments at a proximity of the first eyelet on the second side of the shoe. At least two sets of the at least two shoelace segments, the pull-tab, and the second side of the hook-and-loop fastener. Each of the at least two shoelace segments are hollow tubes made of a woven material. The at least two shoelace segments extend from the aglet channels to the eyelets on the first side of the shoe from a top of the first side of the shoe to a bottom of the first side of the shoe, across the tongue and the tongue opening, and through the eyelets on the second side of the shoe from a top of the second side of the shoe to a bottom of the second side of the shoe. A cord shoelace with a first portion of the cord shoelace positioned on the first side of the shoe and a second portion of the cord shoelace positioned on the second side of the shoe, and a tightening wheel on the second side of the shoe tightening or loosening the cord shoelace with turning of the tightening wheel.

According to an aspect, a quick tightening system for a shoe having a tongue opening, a tongue positioned at the tongue opening, and a first side and a second side divided by the tongue opening, each of the first side and the second side at least partially covering the tongue and including eyelets on portions of the first side and the second side that cover the tongue, the quick tightening system may comprise at least two shoelace segments each comprising an aglet at a distal end of the shoelace segment, each of the two shoelace segments coupled to the first side of the shoe at a proximal end of the shoelace segment and extending through the eyelets on the first side of the shoe, a pull-tab comprising an elongated substrate having a length longer than a width and coupled at a first end to an aglet clip comprising at least two aglet channels each having an aglet opening into the aglet clip wherein the aglet channels each enter the aglet clip on a first side of the aglet clip and extend toward a side of the aglet clip different from the first side of the aglet clip, the aglet channels being defined by at least two channel walls each having a majority of the respective wall's length extending in a direction not parallel to the aglet opening for each aglet channel into the aglet clip, wherein the length of each aglet channel is greater than a distance between the at least two channel walls, wherein each of the aglets of the at least two shoelace segments is removably coupled into one of the two aglet channels while the at least two shoelace segments extend from the aglet channels into the eyelets on the first side of the shoe, the pull-tab further comprising a first side of a hook-and-loop fastener on a bottom surface of the elongated substrate of the pull-tab, and a second side of the hook-and-loop fastener on an outer surface of the second side of the shoe.

Particular embodiments may comprise one or more of the following features. Each of the at least two channel walls may comprise at least one aglet choke extending inward of the at least two channel walls in proximity to each of the aglet openings. The at least one aglet choke may comprise an aglet choke arm extending from a first side of the aglet opening toward a second side of the aglet opening, and extending away from the aglet opening into the aglet channel, the aglet choke arm being fixedly coupled to the first side of the aglet opening and resiliently movable from a rest position to an open position closer to the first side of the aglet opening than in the rest position. The at least two channel walls are parallel to each other. The aglets of the at least two shoelace segments extend separately through the aglet openings. The pull-tab may further comprise a clip cover, the pull-tab further comprising at least one of a protrusion and a depression on the clip cover and at least one of a complementary depression of the protrusion and a complementary protrusion of the depression on the aglet clip removably engaging with each other.

According to an aspect, a quick tightening system for a shoe having a tongue opening, a tongue positioned at the tongue opening, and a first side and a second side divided by the tongue opening, each of the first side and the second side at least partially covering the tongue and including eyelets on portions of the first side and the second side that cover the tongue, the quick tightening system may comprise at least two shoelace segments each comprising an aglet at a distal end of the shoelace segment, each of the two shoelace segments coupled to the first side of the shoe at a proximal end of the shoelace segment and extending through the eyelets on the first side of the shoe, a pull-tab comprising an elongated substrate having a length longer than a width and at least one aglet channel coupled to the elongated substrate at an end of the elongated substrate, the at least one aglet channel sized to removably receive at least a first portion of the aglet into the at least one aglet channel with at least a second portion of the aglet extending through the at least one aglet channel while the at least two shoelace segments extend from the aglet channels into the eyelets on the first side of the shoe, the pull-tab further comprising a first side of a hook-and-loop fastener on a bottom surface of the substrate of the pull-tab, wherein, each of the at least one aglet channel further comprises at least two channel walls defining the aglet channel, the length of each aglet channel being greater than a distance between the channel walls, and a second side of the hook-and-loop fastener on an outer surface of the second side of the shoe.

Particular embodiments may comprise one or more of the following features. Each of the aglet further may comprise an enlarged end enlarged relative to a body of the aglet and with a diameter greater than a diameter of the at least one aglet channel. The enlarged end may be one or more knots of the aglet. The enlarged end may be made of an elastic material. The pull tab may further comprise a cleat on the substrate, the at least a second portion of the aglet extending out of the aglet channel being attached to the cleat.

According to an aspect, a quick tightening system for a shoe having a tongue opening, a tongue positioned at the tongue opening, and a first side and a second side divided by the tongue opening, each of the first side and the second side at least partially covering the tongue and including eyelets on portions of the first side and the second side that cover the tongue, the quick tightening system may comprise at least two shoelace segments each comprising an aglet at a distal end of the shoelace segment, each of the two shoelace segments coupled to the first side of the shoe at a proximal end of the shoelace segment and extending through the eyelets on the first side of the shoe, a pull-tab comprising an elongated substrate and coupled at a first end to an aglet clip comprising at least one aglet channel each having an aglet opening into the aglet clip, each of the aglets is removably coupled into the at least one aglet channel while the at least two shoelace segments extend from the at least one aglet channel and into the eyelets on the first side of the shoe, the pull-tab further comprising a first side of a hook-and-loop fastener on a bottom surface of the substrate of the pull-tab, the at least one aglet channel further comprises at least two channel walls extending from the aglet opening and defining the at least one aglet channel, the length of each aglet channel being greater than a distance between the channel walls, and the aglet channel further comprises at least one aglet choke movably extending inward from at least one of the channel walls and engaging the aglet, and a second side of the hook-and-loop fastener on an outer surface of the second side of the shoe.

Particular embodiments may comprise one or more of the following features. The at least one aglet choke may comprise an aglet choke arm extending from a first side of the aglet opening toward a second side of the aglet opening, and extending away from the aglet opening into the aglet channel, the aglet choke arm being fixedly coupled to the first side of the aglet opening and resiliently movable from a rest position to an open position closer to the first side of the aglet opening than in the rest position. Each of the at least one aglet choke may have a pairing aglet choke on an opposing channel wall. Each of the at least one aglet choke may have a pairing aglet choke on an opposing channel wall. The at least one aglet choke may be a cam cleat. The pull-tab may further comprise at least one of a protrusion and a depression on the clip cover and at least one of a complementary depression of the protrusion and a complementary protrusion of the depression on the aglet clip removably engaging with each other. The channel walls may be parallel to each other. The aglets may extend separately through the aglet openings.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. §112, ¶6. Thus, the use of the words "function," "means" or "step" in the Detailed Description or Description of the Drawings or claims is not intended to somehow indicate a desire to invoke the special provisions of 35 U.S.C. §112, ¶6, to define the invention. To the contrary, if the provisions of 35 U.S.C. §112, ¶6 are sought to be invoked to define the inventions, the claims will specifically and expressly state the exact phrases "means for" or "step for", and will also recite the word "function" (i.e., will state "means for performing the function of [insert function]"), without also reciting in such phrases any structure, material or act in support of the function. Thus, even when the claims recite a "means for performing the function of . . . "or "step for performing the function of . . . ," if the claims also recite any structure, material or acts in support of that means or step, or that perform the recited function, then it is the clear intention of the inventors not to invoke the provisions of 35 U.S.C. §112, ¶6. Moreover, even if the provisions of 35 U.S.C. §112, ¶6 are invoked to define the claimed aspects, it is intended that these aspects not be limited only to the specific structure, material or acts that are described in the preferred embodiments, but in addition, include any and all structures, materials or acts that perform the claimed function as described in alternative embodiments or forms of the disclosure, or that are well known present or later-developed, equivalent structures, material or acts for performing the claimed function.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DETAILED DESCRIPTION

Various embodiments of systems, apparatuses, and methods disclosed herein comprise a shoe tightening system comprising a combination of a shoelace and hook and loop fasteners with replaceable shoelaces. Shoes using the described tightening system may comprise any of a variety of general and specialty shoes, such as but not limited to cycling shoes, running shoes, and other athletic shoes. It is further contemplated that any of the tightening systems described herein may be used alone on the shoe, or in combination with each other, or with any other shoe tightening systems known in the art.

Figure 1B:
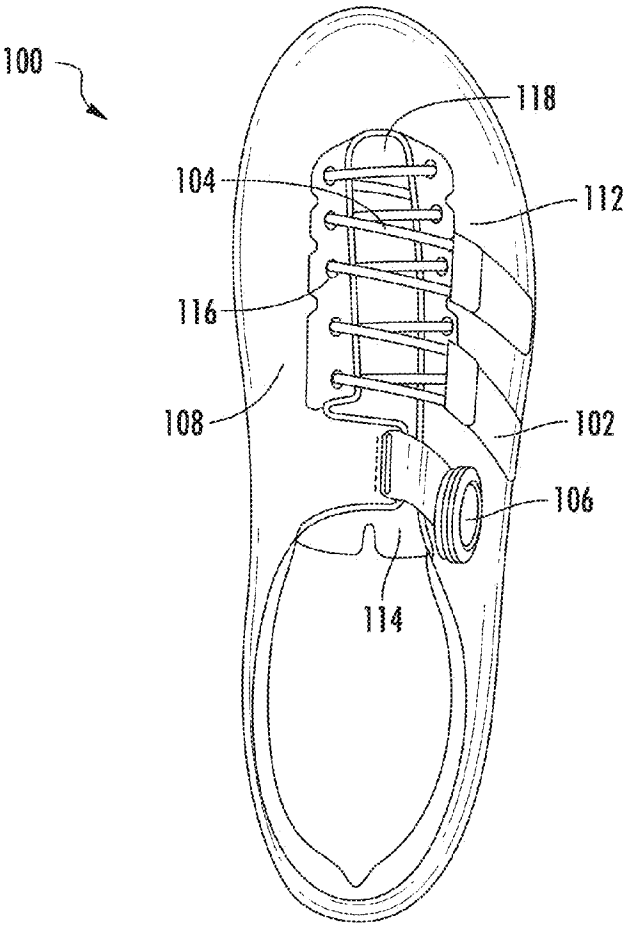
FIG. 1B is a top view of a shoe implemented with a quick shoe tightening system and a rotational cord lock.
Figure 1A:
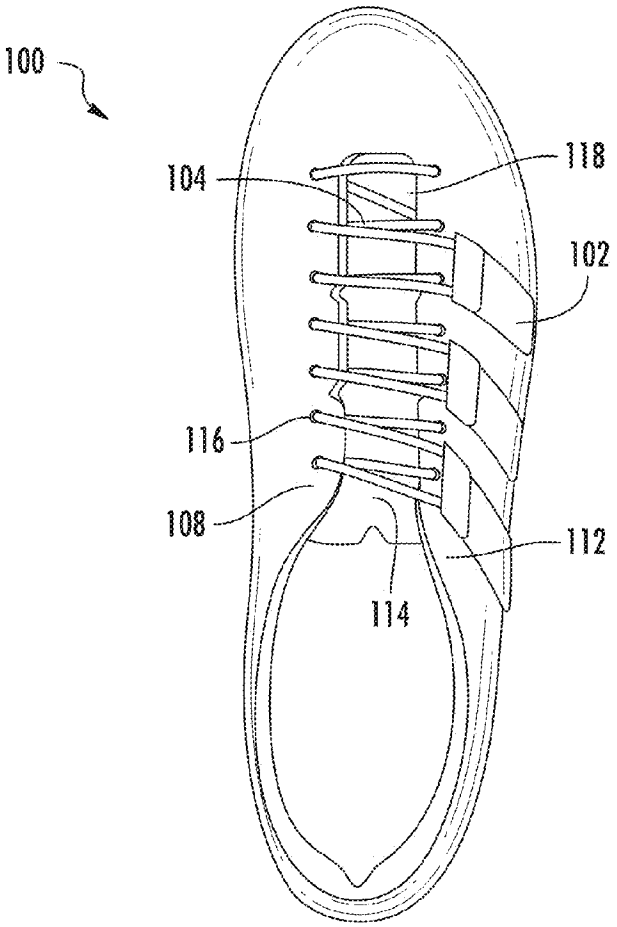
FIG. 1A is a top view of a shoe implemented with an embodiment of a quick shoe tightening system.
Figure 2B:
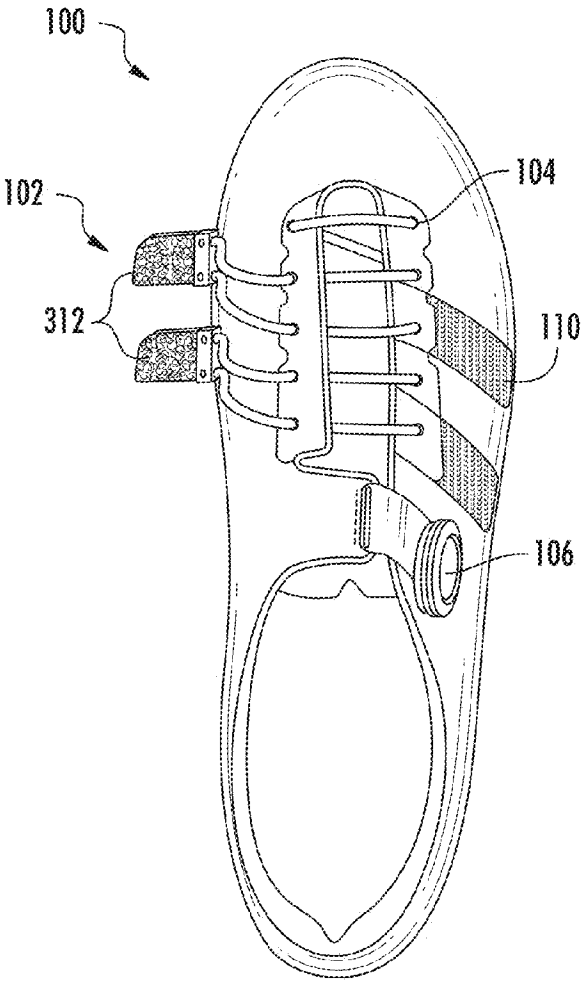
FIG. 2B is a shoe implemented with the quick shoe tightening system of FIG. 1B with the hook-and-loop fasteners pulled apart.
Figure 2A:
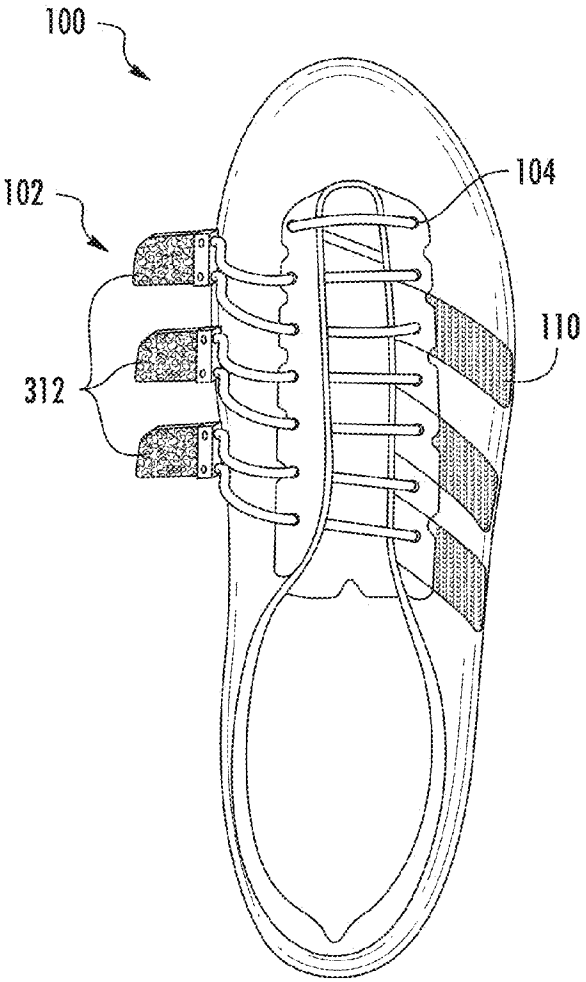
FIG. 2A is a shoe implemented with the quick shoe tightening system of FIG. 1A with the hook-and-loop fasteners pulled apart.

According to some aspects, a shoe tightening system comprises a combination of both a shoelace and hook and loop fasteners to tighten the shoe around the foot of a wearer. Each shoe may include one or more tightening systems. As shall be described in greater detail below, each tightening system may comprise at least one shoelace and a pull-tab coupled to one or more ends of shoelaces. The pull-tab may comprise either hook or loop material of a hook and loop fastener while the shoe comprises complementary material on a coupling surface. FIGS. 1A and 1B depict two non-limiting embodiments of shoes comprising tightening systems according to this disclosure with the pull-tabs 102 coupled on the shoe. FIGS. 2A and 2B depict two non-limiting embodiments of shoes comprising tightening systems according to this disclosure with the pull-tabs 102 pulled away from the shoe and the two sides 312 and 110 of each hook-and-loop fastener pulled apart. Referring to FIGS. 1A and 1B, a shoe may comprise a tongue opening 8 that divides the shoe into a first side 108 and a second side 112. A tongue 114 is positioned at the tongue opening 118 of the shoe and at least partially covered by the first side 108 and the second side 112. The first side 108 and second side 112 include eyelets 116 on their portions that cover the tongue 114.

Referring to FIGS. 2A and 2B, a tightening system 100 comprises at least one shoelace segment 104 each comprising an aglet at a distal end of the shoelace segment, a pull-tab 102 comprising one side of a hook-and-loop fastener 312 on the bottom surface of the pull-tab, and the other side of the hook-and-loop fastener 110. Ordinarily an aglet is a metal or plastic tube fixed tightly around each end of a shoelace. As used herein, however, the term aglet is used to refer not only to the conventional metal or plastic tube fixed tightly around each end of a typical shoelace, but also, or alternatively, any other feature at or near the end of a shoelace segment that gives the end region of the shoelace rigidity or gives a portion of the shoelace segment a larger size, including, but not limited to, covers, clips, and knots. The shoelace segments couple to the first side of the shoe at a proximal end of the shoelace segment and extend through the eyelets on the first side of the shoe. Although the particular embodiments shown in the attached Figures illustrate an eyelet as a hole that extends through a side of the shoe adjacent the tongue opening, it is intended that eyelet refer not only to this style of eyelet, but also to other styles of eyelets such as loops of material, brackets and other components that a shoelace segment can extend through or around and return back to the side of the shoe on which it started.

As shown, a shoe may comprise three tightening systems (FIGS. 1A and 2A) or two tightening systems accompanied by a conventional cord tightening system 106 (FIGS. 1B and 2B), which comprises a cord shoelace with a portion positioned on the first side of the shoe and another portion positioned on the second side of the shoe and a tightening wheel on the second side of the shoe for tightening or loosening the cord shoelace with the turning of the tightening wheel. Other shoe embodiments may comprise one, four, five, or more tightening systems with or without additional conventional cord tightening systems.

Various embodiments of a tightening system on a shoe comprise a pull-tab 102. A pull-tab is configured to removably couple to a coupling surface of the shoe. In the non-limiting embodiments shown in FIGS. 2A-2B, the coupling tab comprises the first side 312 (loops depicted) of a hook-and-loop fastener configured to couple to the second side 110 (hooks depicted) of the hook-and-loop fastener on the coupling surface of the shoe to form a hook and loop fastened section (such as but not limited to VELCRO™). In other embodiments, the pull-tab may comprise hooks and the coupling surface of the shoe may comprise loops to form a hook and loop fastened section. The pull-tab and the coupling surface may comprise any combination of hooks and loops to form a hook-and-loop fastener. While hook and loop fasteners are referenced herein to couple the coupling section of the pull-tab to the coupling surface of the shoe, it is contemplated that other suitable couplings known in the art may also be used. In some embodiments, the coupling surface of the shoe is formed proximate to the second side of the shoe or the side opposite to the side of the eyelets where the strands of the lace first pass through after extending from the aglet clip.

It is noted that use of the coupling tab of the pull-tab and the coupling surface of the shoe is advantageous to conventional cycling shoes because it provides a user the advantages of both a VELCRO strap and shoelaces. VELCRO straps allow a user to tighten the shoe to various levels of tightness very quickly, but do not provide the flexibility of a shoelace once coupled. On the other hand, shoelaces typically take time to adjust to correct tightness and then tie. By combining the shoelaces with the pull-tab, a user can quickly tighten the shoe to a desired level of comfort, and still have the flexibility associated with shoelaces once the pull-tab is coupled to the shoe.

It is noted that embodiments of the shoe tightening systems disclosed herein are also advantageous to conventional systems because a user may replace worn or undesired shoelaces or pull-tabs.

Figure 3A:
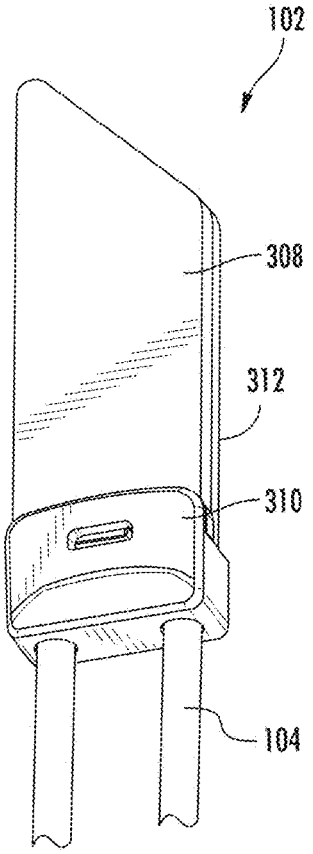
FIG. 3A is a top perspective view of a pull-tab with a clip cover covering an aglet clip.
Figure 3B:
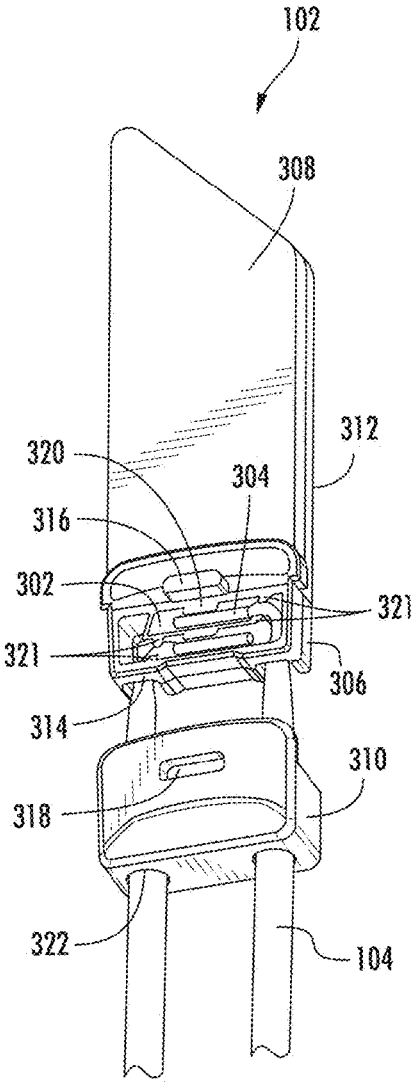
FIG. 3B is a top perspective view of a pull-tab with a clip cover pulled away from the aglet clip.

Referring now to FIGS. 3A and 3B, a non-limiting embodiment of a pull-tab 102 implemented with the present disclosure is depicted. FIGS. 3A-3B are top views of a pull-tab 102 configured to removably couple to one or more ends of shoelaces, and still have the advantages of the pull-tab and shoelace combinations described above. Moreover, the embodiment of the pull-tab shown in FIGS. 3A-3B may be applied to any shoes, lace-up configurations, shoelaces, and the like described elsewhere in this document or otherwise known in the art without departing from the scope of this disclosure. In some embodiments, a pull-tab 102 may comprise an elongated substrate 308 and an aglet clip 306 coupled to the elongated substrate 308 at the end of the substrate. The bottom side of the elongated substrate 308 may comprise one side 312 of a hook-and-loop fastener. An aglet clip 306 may comprise aglet channels 302 for receiving aglets 304. A pull-tab 102 may further comprise a clip cover 310 that covers the aglet clip 306. To remove shoelaces, a user need only pull the aglet from the aglet channel and the shoelaces from the shoe. Once a new shoelace has been laced according to one of the lace-up configurations described below (or other lace-up configurations), a user need only insert the aglet of the shoelace into the aglet channels of the aglet clip in the pull-tab and engages the shoelaces with the pull-tab.

Referring now to FIGS. 4A-4D, top perspective, top, and front views of aglet clip 306 (FIGS. 4A-4C) and a top view of a clip cover 310 (FIG. 4D) of a non-limiting embodiment are provided. The aglet clip 306 may comprise at least one aglet channel 302 and at least one aglet opening 314. Each of the aglet channels 302 may have a separate aglet opening 314. Aglet clip 306 may further comprise channel walls 324 along the aglet channels, or between the aglet channels. The channel walls 324 may separate the aglet channels 302 into separate channels or keep the aglet channels 302 in complete communication with each other as a common channel 302 (see FIG. 5B, for example). In some embodiments, the aglet channels 302 may be parallel to each other.

Each of the channel walls 324 may further comprise at least one aglet choke 321 at the proximity of each of the aglet openings 314. In particular embodiments (see FIGS. 4A and 4B, for example), the aglet chokes 321 may extend inward on opposing sides of the aglet channels 302 proximate an opening 314 to the channel 302 to narrow a portion of the channel, pinch the shoelace, and/or restrict the aglet 304 from escaping the channel 302. When the aglets 304 are placed in the channels 302, the aglet chokes 321 engage the neck of the shoelace that is between the aglet 304 and the rest of the shoelace segment 104, and discourage the aglets 304 from sliding out the channels 302 and the aglet clip 306.

Figure 4C:
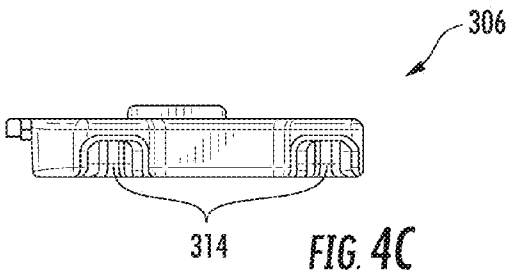
FIG. 4C is a front side view of an aglet clip.
Figure 4D:
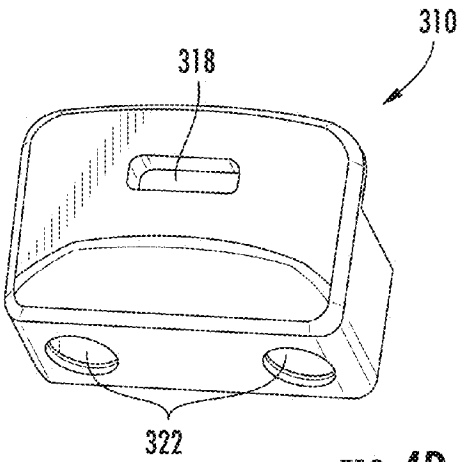
FIG. 4D is a top perspective view of a clip cover.
Figure 4A:
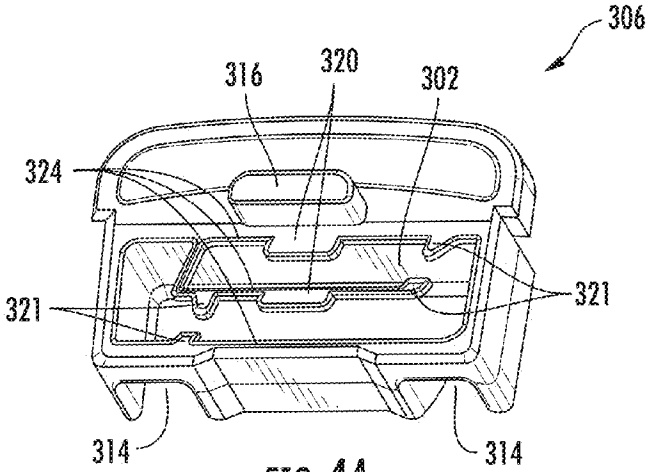
FIG. 4A is a top perspective view of an aglet clip.
Figure 4B:
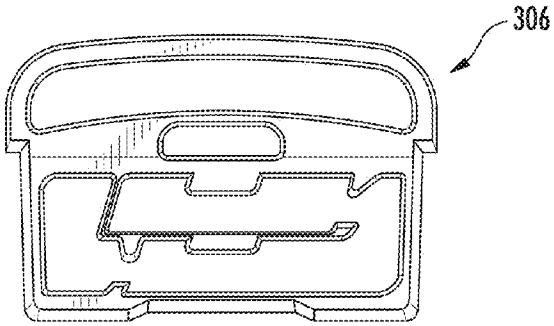
FIG. 4B is a top view of an aglet clip.
Figure 4E:
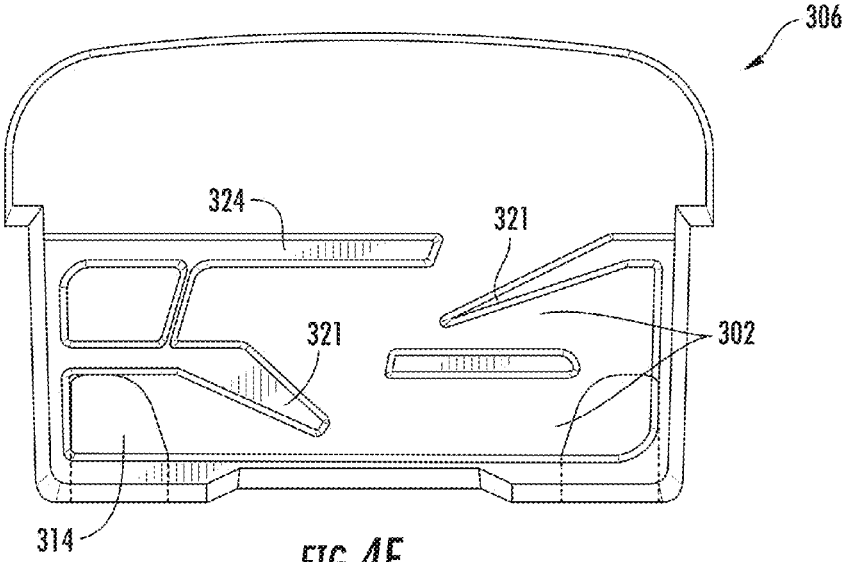
FIG. 4E is a top view of an embodiment of an aglet clip with active clamps.
Figure 4F:
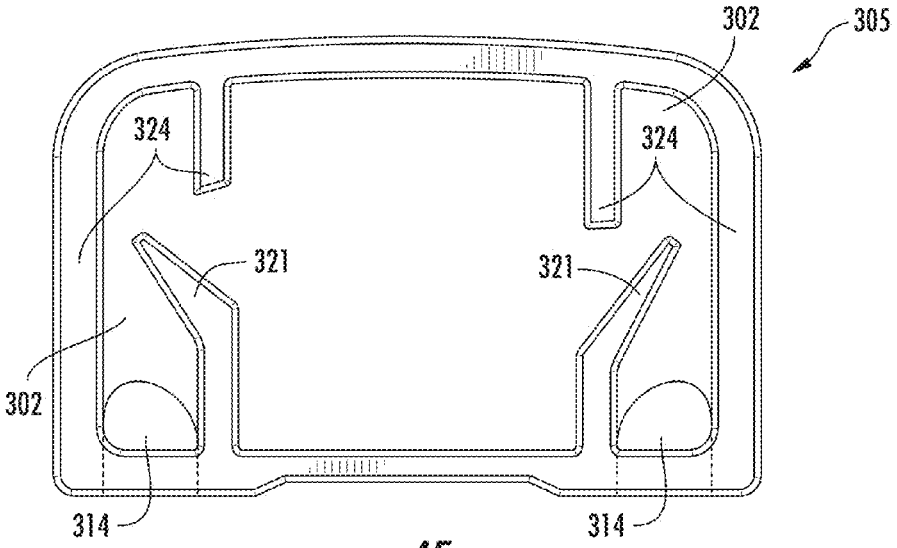
FIG. 4F is a top view of another embodiment of an aglet clip with active clamps.

In particular embodiments (see FIGS. 4E and 4F, for example), the aglet chokes 321 may be active clamps on at least one of the channel walls. The active clamps allow a wearer to adjust the length of the shoelace coming out of the aglet clip without replacing the entire shoelace. In some embodiments, each of the aglet choke has a pairing aglet choke on the opposing channel wall. In some embodiments, the aglet chokes may be cam cleat pairs. In some embodiments, the aglet chokes 321 are formed of resilient material, such as thin plastic, to compress as the shoelace and/or aglet is pressed through the aglet choke 321. In particular embodiments, the resilient aglet chokes 321 may be formed as one or more aglet choke arms 321 extending inward from sides of each opening 314, but also extending farther into the aglet clip 306, 305 from the opening 314 to the aglet channel 302. The resilient aglet chokes 321 are each fixedly attached to one of the sides of the opening, but are movable from its rest position in relation to the other surfaces surrounding the opening. When an aglet 304 is inserted into the channel opening 314, the farthest interior ends of the one or more aglet choke arms 321 associated with each aglet channel opening 314 flexes from its rest position toward the side of the channel opening 314 to which it is attached to allow the aglet 304 to pass the aglet choke 321. However, when the aglet 304 gets past the aglet choke 321, the tip of the aglet choke 321 reflexively and resiliently moves away from the wall to which it is attached toward its rest position to impinge the shoelace segment behind the aglet 304. If the shoelace is pulled after the aglet 304 is past the aglet choke 321, the aglet choke 321, now having force applied to it from inside the aglet clip 306, 305, more tightly impinges the shoelace segment 104 to restrict the shoelace segment 104 from being released from the aglet clip 306, 305. To adjust the fitting of the shoe by adjusting the length of the shoelace outside the aglet clip, the wearer may push the shoelace further into the aglet clip, or pull the shoelace out of the aglet clip while holding the aglet chokes, in a desired amount. The clip embodiments of FIGS. 4E and 4F are also used with laces 104, aglets 304, an elongated substrate 308 and a clip cover 310, indent and depression in the clip and cover, like that illustrated in FIGS. 3A, 3B and 4D, the clip cover being adapted slightly for the particular shape and internal structure of the embodiments of FIGS. 4E and 4F.

In particular embodiments, the channel walls 324 may further comprise retention clips 320. In other embodiments, the aglet channels may be at an angle in relation to each other than parallel. In some embodiments, the retention clips 320 may extend above the aglet channels and at least partially cover the aglet channels 302. The aglet clip 306 may further comprise a protrusion 316 positioned to mate with an aperture or depression 318 of the clip cover 310. A clip cover 310 may comprise a complementary depression 318 and may further comprise a clip cover opening 322 for coupling the clip cover with shoelaces. When the clip cover 310 is at a closed position, the clip cover 310 is placed on the aglet clip 306 and the protrusion 316 and the complementary depression or aperture 318 engage each other. When the clip cover 310 is at an open position, the protrusion 316 and the complementary depression 318 are disengaged and the dip cover 310 does not cover the aglet clip 306. In some embodiments, the aglet clip may comprise a depression and the clip cover may comprise a complementary protrusion and the depression and the complementary protrusion engage each other when the dip cover is at a closed position, and are disengaged when the clip cover 310 is at an open position. The aglet clip and the clip cover may comprise any of a number of a protrusions, tabs, slots, openings, and the like complementary with one another to allow the clip cover to snap fit to the aglet clip. Alternatively, the clip cover may couple to the aglet clip with other couplings, such as but not limited to magnets, adhesives, straps, hook and loop connectors, and the like.

Referring back to FIGS. 3A and 3B, in a non-limiting embodiment, shoelaces 104 are engaged with a clip cover 310 and placed in aglet clip 306. Shoelaces 104 may enter the clip cover 310 through clip cover openings 322 and engage with the clip cover 310. The clip cover 310 may slide along the shoelaces 104 to engage with, or disengage from, the aglet clip 306. Shoelaces 104 may further enter the aglet clip 306 through the aglet openings 314 and then the aglets 304 may be at least partially placed in aglet channels 302. In some embodiments, the aglet channels 302 may each lead from a separate aglet opening 314 and then turn toward a side of the aglet clip different from the side of the aglet clip for the aglet opening, and then the shoelaces 104 may each enter into a separate aglet opening 314 and further into separate aglet channel 302. In this way, the aglets can be secured in the aglet channels due to different directions of forces applied on the aglets. The aglets 304 may be further secured by being placed under retention clips 320, which prevent the aglets 304 from popping out of the aglet channels 302.

Figure 5B:
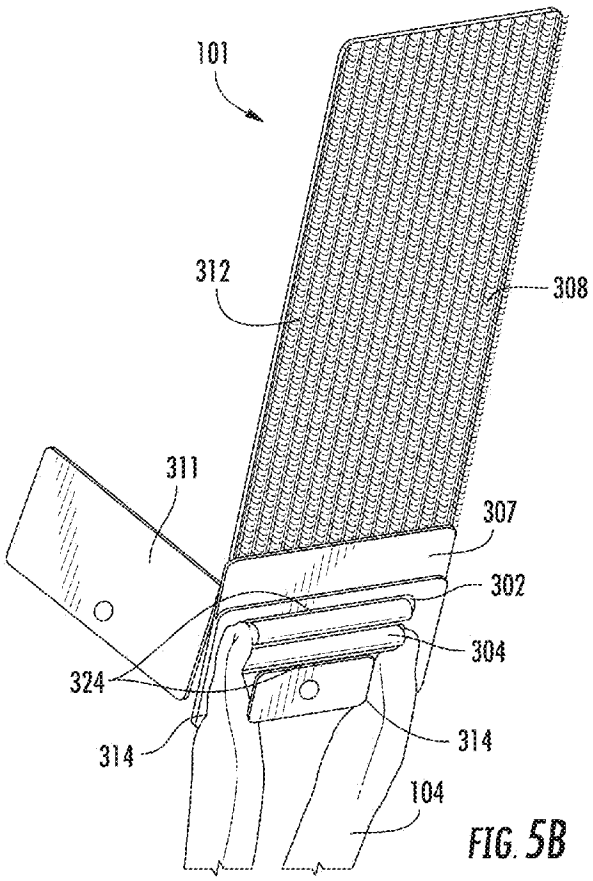
FIG. 5B is a bottom view of another embodiment of a pull-tab with a clip cover pulled away from the aglet clip.
Figure 5A:
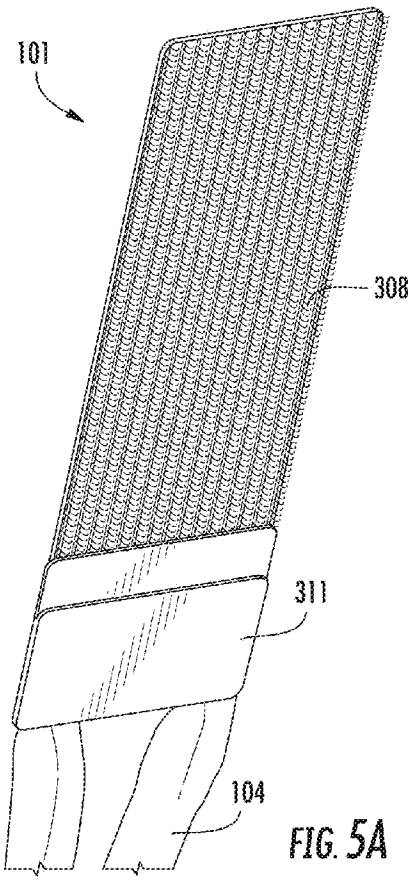
FIG. 5A is a bottom view of another embodiment of a pull-tab with a clip cover covering the aglet clip.

Referring now to FIGS. 5A-5B, another non-limiting embodiment of a pull-tab 101 comprising an aglet clip configured to receive and removably couple one or more ends of a shoelace to the pull-tab 101 is depicted. In some embodiments, a pull-tab 101 may comprise an elongated substrate 308 having a length greater than its width. The elongated substrate 308 is engaged at its end to an aglet clip 307.

For the embodiments of FIGS. 3A-5B, the aglet clip 306, 307 may comprise at least one aglet channel 302 having at least one aglet opening 314 into the aglet clip 306, 307. The at least one aglet channel 302 may enter into the aglet clip 306, 307 through the same side of the aglet clip 306, 307 as that of the aglet openings 314 on the aglet clip. The aglet channels 302 may be defined by at least two channel walls 324 extending from the aglet opening 314 of the aglet channels, where the length of each aglet channel 302 is greater than a distance between the channel walls 324. In some embodiments, the channel walls 324 may be parallel to each other. In some embodiments, the aglets of the shoelace each extend separately through the aglet openings 314. An aglet channel 302 may be sized to receive two or more aglets 304. In some embodiments, the aglet clip may comprise channel walls 324 between the aglet channels and each aglet channel may be sized to receive only a single aglet 304 of a shoelace. In some embodiments, the aglet channel 302 may be sized to grip the one or more aglets 304 within the aglet channel 302 such that the aglets 304 are slightly pinched or held within the aglet channel 302 by the friction resulting from the pressure fit of the aglets 304 within the aglet channel 302. Aglets 304 with enlarged heads (described below) may optionally be used as well to prevent the aglet from slipping out of the aglet channels 302.

In some embodiments (see FIGS. 3A-4E and 5A-5B, for example), the aglet channel 302, after entering the aglet opening 314, may then turn toward a side different from that of the aglet opening on the aglet clip, and each of the aglet channels has a majority of its respective wall's length extending in a direction not parallel to the opening for each aglet channel 302. According to some aspects, the aglet channel 302 may extend transversely or latitudinally across the pull-tab such that the aglet channel 302 (and the aglets 304 positioned within the aglet channels 302) are angled (greater than 45, 60, or 75 degrees) or perpendicular to the direction of the shoelace when the pull-tab is pulled to tighten the laces or when the pull-tab is coupled to the coupling section of the shoe. This configuration is advantageous because it inhibits the aglet 304 and the end of the shoelace from being pulled out of or otherwise separated from the pull-tab. The relative stiffness of the aglet 304 also helps prevent the aglet 304 from sliding out of the aglet clip 306, 307 when the shoelace is angled or perpendicular relative to the shoelaces leading from the aglet channels 302.

In some embodiments, an aglet clip of a pull-tab comprises a clip cover configured to removably couple to the aglet clip and covers the aglet channels. Referring to FIG. 5A, the clip cover 311 is shown removed from covering the aglet clip 306. The clip cover 311 may be wholly separate from the aglet clip 307 when removed from covering the aglet clip 307. Alternatively, the clip cover 311 may be coupled to the aglet clip 307 at one end or one point and movable from an open position with the aglet clip uncovered to a closed position with the aglet clip covered.

In any event, the clip cover and the aglet clip may be configured such that they snap fit with each other. Accordingly, the clip cover and the aglet clip may comprise any of a number of a protrusions, tabs, slots, openings, and the like complementary with one another to allow the clip cover to snap fit to the aglet clip. Alternatively, the clip cover may couple to the aglet clip with other couplings, such as but not limited to magnets, adhesives, straps, hook and loop connectors, and the like.

Figure 6A:
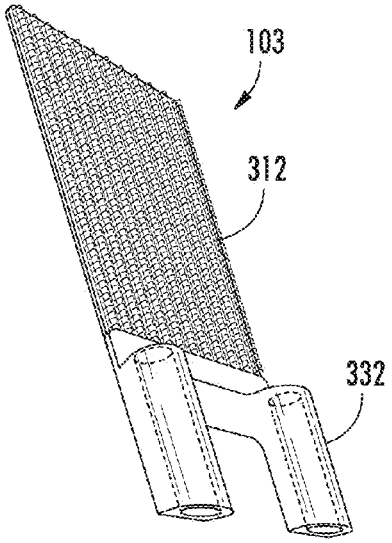
FIG. 6A is a bottom view of one more embodiment of a pull-tab without shoelaces engaged.
Figure 6B:
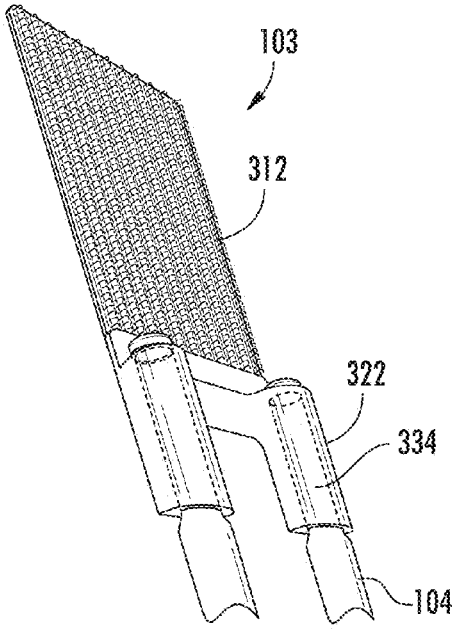
FIG. 6B is a bottom view of one more embodiment of a pull-tab with shoelaces engaged.

Referring now to FIGS. 6A and 6B, one more non-limiting embodiment of a pull-tab 103 according to this disclosure is depicted. In some embodiments, the pull-tab 103 comprises at least one aglet channel 302 sized to removably receive at least a portion of an aglet 334 and at least a portion of the aglet extends through the at least one channel. In some embodiments, the aglet channels 332 are each sized to receive one aglet 334 of the shoelace. The aglet channels may comprise continuous channel with two opposing open ends. Various embodiments of a tightening system may further comprise two or more aglets 334, with a different one of the aglets 334 being coupled to a different one of aglet channels 332.

Figure 7A:
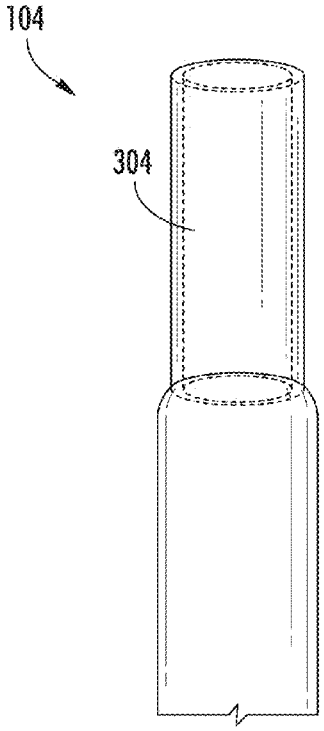
FIG. 7A depicts the aglet portion of a shoelace.
Figure 7B:
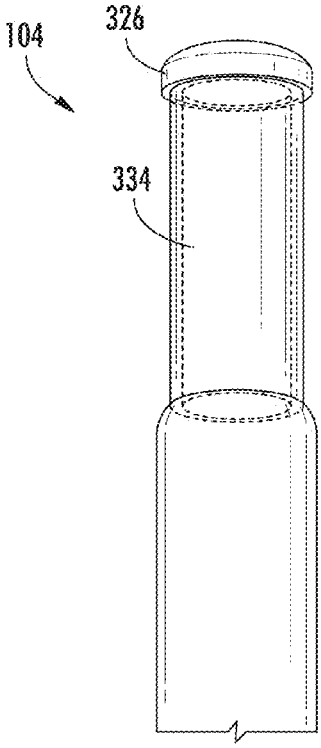
FIG. 7B depicts the aglet portion of a shoelace with an enlarged head on the aglet.

According to some aspects (shown in FIG. 7B), an aglet 334 of this disclosure may comprise a head 326 enlarged relative to a body of the aglet (compared to regular aglet as shown in FIG. 7A), where the head 326 has a diameter greater than the diameter of the aglet channel 332. In some embodiments, the head 326 may be rounded, pointed, or have an otherwise decreasing dimension opposite the body of the aglet to allow the head to be more easily inserted into and passing through an aglet channel 332. According to some aspects, the head 326 comprises a material with enough elasticity or plasticity to at least partially compress to fit through the aglet channel 332, and then expand after passing through the aglet channel 332. In some embodiments, the aglet with the enlarged head 326 comprises an attachable hollow body sized to fit over and couple to an end of a shoelace. In some embodiments, the end of the shoelace may comprise a second, standard shoelace aglet on its end that fits within the attachable enlarged head 326. Thus, once passed through the aglet channel 332, a portion of the head 326, such as a protruding edge, comprises a diameter or width greater than a diameter or width of the aglet channel. The head 326 may further comprise a protruding edge adjacent to the aglet body configured to engage the aglet channel 332 once the head has passed through the aglet channel 332. Such a configuration discourages the head from being pulled back through the aglet channel 332 as the shoelace of the tightening system is tightened by engagement between the protruding edge of the head and the aglet channel 332. In other embodiments, one or more knots or some other bulbous protrusion may form the enlarged head 326 to prevent the shoelace from slipping out of the aglet channel 332. In some embodiments, the pull tab further comprises a cleat on the substrate, and the portion of the aglet extending out of the aglet channels is attached to the cleat by being wound around the cleat or other means known in the art.

Various embodiments may comprise differing lace-up configurations of tightening systems. FIG. 8B depicts a non-limiting embodiment of the lace-up configuration of three tightening systems of a shoe shown in FIG. 8A. In FIG. 8B, the shoelaces are shown in black or grey, with the grey area of the shoelaces indicating the lace is positioned under the outer surface of the shoe.

In some embodiments, a lace-up configuration of a tightening system comprises at least two ends of a shoelace coupled to a pull-tab to form at least two strands 104 of the shoelace extending from the pull-tab. The strands 104 of the shoelace extend from the pull-tab to eyelets on a first side of the shoe. After each of the strands passes through a different eyelet of the eyelets on the first side of the shoe, the strands may extend across a tongue, a tongue opening, and/or a top portion of the shoe to eyelets on a second side of the shoe. After each of the strands passes through a different eyelet of the eyelets on the second side of the shoe, the strands join with one another between the eyelets on the second side of the shoe. According to some aspects, the strands of the shoelace pass from the top to the bottom of the first side of the shoe when passing through the eyelets on the first side of the shoe, as well as pass from the top to the bottom of the second side of the shoe when passing through the eyelets on the second side of the shoe. In the non-limiting embodiment in FIGS. 8A, 8B, 9A, and 9B, the bottom two tightening systems in FIGS. 8A and 8B and the bottom tightening system in FIGS. 9A and 9B comprise this lace-up configuration.

Figure 8A:
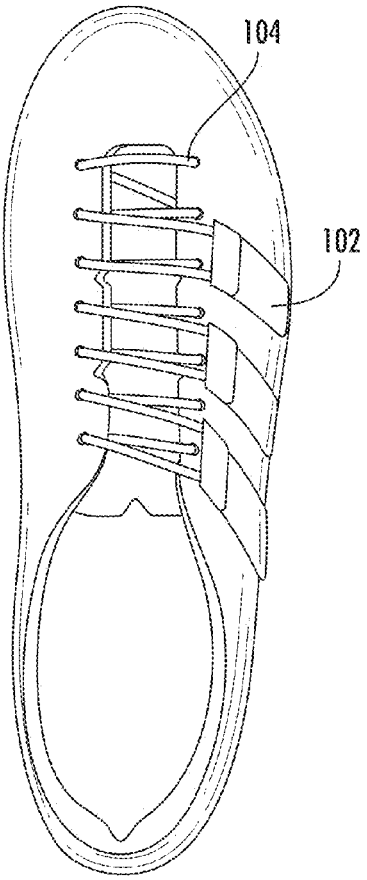
FIG. 8A is a top view of a shoe implemented with an embodiment of a quick shoe tightening system.
Figure 8B:
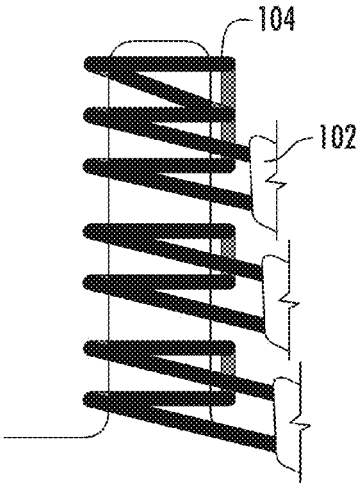
FIG. 8B depicts the lace-up configuration of an embodiment of a quick shoe tightening system depicted in FIG. 8A.
Figure 9A:
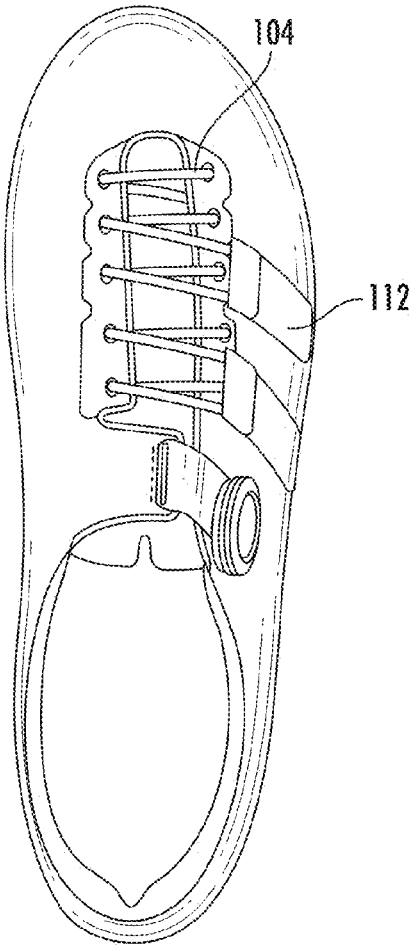
FIG. 9A is a top view of a shoe implemented with another embodiment of a quick shoe tightening system.
Figure 9B:
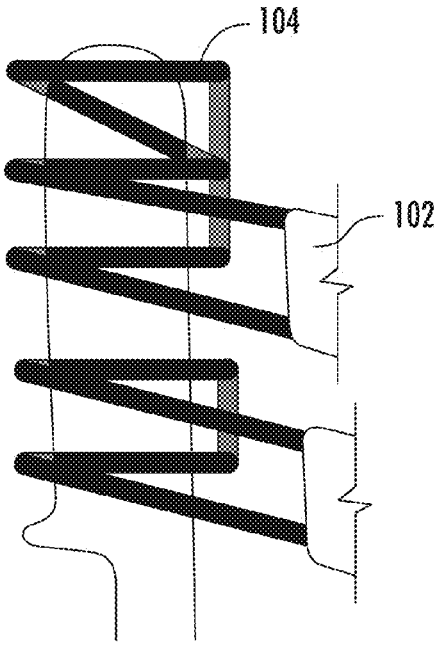
FIG. 9B depicts the lace-up configuration of the embodiment of a quick shoe tightening system depicted in FIG. 9A.

Some tightening systems may comprise other lace-up configurations, such as the top tightening system in FIGS. 8A and 8B and the top tightening system in FIGS. 9A and 9B comprise the following two lace-up configurations.

In some embodiments, the strands of the shoelace extend from the pull-tab to the eyelets on the first side of the shoe. After each of the strands passes through a different eyelet of the eyelets on the first side of the shoe, the strands extend across a tongue, a tongue opening, and/or a top portion of the shoe to eyelets on a second side of the shoe. In some embodiments, after each of the strands passes through a different eyelet of the eyelets on the second side of the shoe, a first strand of the strands extends across the tongue, the tongue opening, and/or the top portion of the shoe to a third eyelet on the first side of the shoe. After passing through the third eyelet on the first side of the shoe, the first strand extends across the tongue, the tongue opening, and/or the top portion of the shoe to a third eyelet on the second side of the shoe. After passing through the third eyelet on the second side of the shoe, the first strand joins with other strands next to the third eyelet on the second side of the shoe. The other strands only extend from the eyelet on the second side of the shoe to join the first strand on the second side of the shoe, and not extending across the tongue, the tongue opening, and/or the top portion of the shoe after passing through the eyelet on the second side of the shoe.

In some embodiments, after each of the strands passes through a different eyelet of the eyelets on the second side of the shoe, a first strand extends further to a third eyelet on the second side of the shoe. After passing through the third eyelet on the second side of the shoe, the first strand extends across the tongue, the tongue opening, and/or the top portion of the shoe to a third eyelet on the first side of the shoe. After passing through the third eyelet on the first side of the shoe, the first strand extends further across the tongue, the tongue opening, and/or the lop portion of the shoe to join with other strands next to the eyelet on the second side of the shoe where the first strand first passes through the eyelets on the second side of the shoe. The other strands only extend from the eyelets on the second side of the shoe to join the first strand on the second side of the shoe, and not extending across the tongue, the tongue opening, and/or the top portion of the shoe after passing through eyelets on the second side of the shoe.

In some embodiments, the strands may extend from the eyelets on the second side of the shoe, across the tongue, the tongue opening, and/or the top portion of the shoe to additional eyelets on the side of the shoe. After passing through the additional eyelets on the first side of the shoe, the strands may again traverse the tongue, the tongue opening, and/or the top portion of the shoe before extending through additional eyelets in the second side of the shoe and joining with each other between the additional eyelets in the second side of the shoe.

A shoe comprising two or more tightening systems may comprise any of the lace-up configurations described above. FIGS. 8B and 9B depict an embodiment of a shoe comprising two different lace-up configurations.

Figure 10:
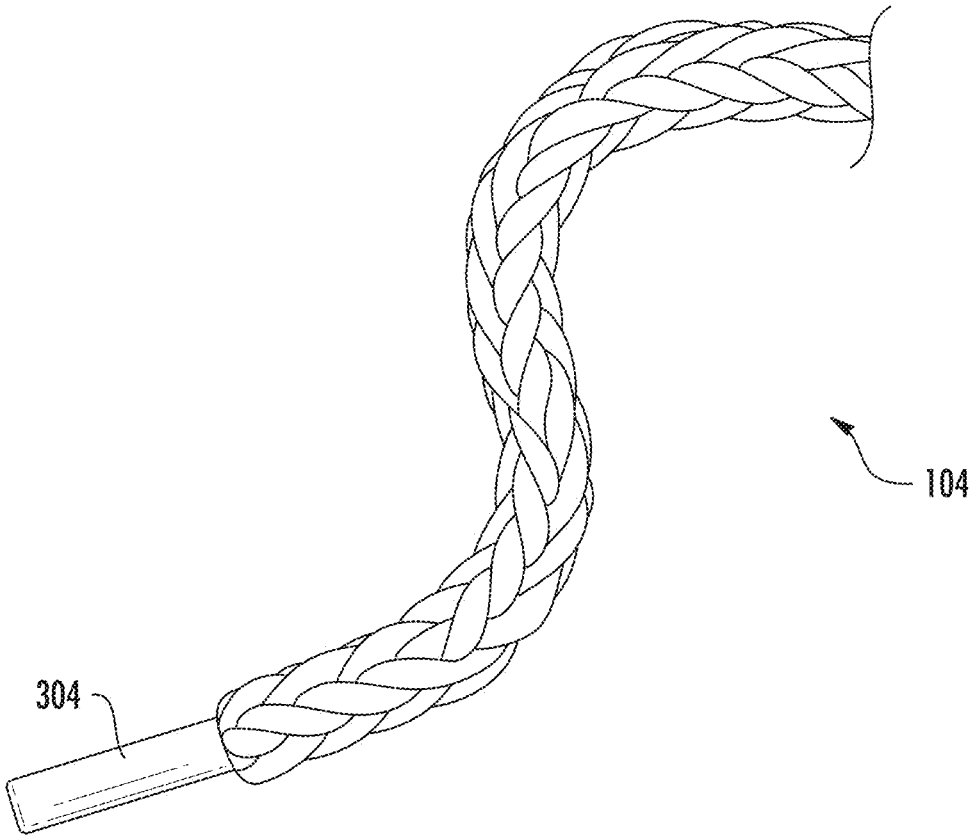
FIG. 10 depicts a shoelace segment.

In most embodiments, the shoelaces are designed to both compress and stretch. The shoelaces may be made of a woven material (as shown in FIG. 10). The shoelaces may have a tubular configuration, but appear substantially flat. By using tubular shoelaces that compress and stretch, a specific single shoelace may have degree of tightness that is independent of the same shoelace elsewhere on the shoe.

This disclosure, its aspects and implementations, are not limited to the specific components or assembly procedures disclosed herein. Many additional components and assembly procedures known in the art consistent with the intended shoe and shoe tightening system and/or assembly procedures for a shoe and shoe tightening system will become apparent for use with implementations of shoes and tightening systems from this disclosure. In places where the description above refers to particular implementations of a shoe tightening system, it should be readily apparent that a number of modifications may be made without departing from the spirit thereof and that these implementations may be applied to other shoe and tightening systems. Accordingly, for example, although particular shoes and tightening systems are disclosed, such shoes and tightening systems and implementing components may comprise any shape, size, style, type, model, version, class, grade, measurement, concentration, material, quantity, the like as is known in the art for such shoes and tightening systems and implementing components, and/or the like consistent with the intended operation of shoe tightening systems may be used.

The invention claimed is:

1. A quick tightening system for a shoe having a tongue opening, a tongue positioned at the tongue opening, and a first side and a second side divided by the tongue opening, each of the first side and the second side at least partially covering the tongue and including eyelets on portions of the first side and the second side that cover the tongue, the quick tightening system comprising:

at least two shoelace segments each comprising an aglet at a distal end of the shoelace segment, each of the two shoelace segments coupled to the first side of the shoe at a proximal end of the shoelace segment and extending through the eyelets on the first side of the shoe;

a pull-tab comprising an elongated substrate coupled at a first end to an aglet clip comprising at least two aglet channels each having a separate aglet opening into the aglet clip wherein the aglet channels each separately enter the aglet clip on a first side of the aglet clip and turn toward a side of the aglet clip different from the first side of the aglet clip, the pull-tab further comprising a clip cover slidably engaged with the at least two shoelace segments and slidable from an open position on the at least two shoelace segments to a closed position wherein the aglet cover engages and covers the two aglet channels of the aglet clip, wherein each of the aglets of the at least two shoelace segments is removably coupled into one of the two aglet channels while the at least two shoelace segments extend from the aglet channels into the eyelets on the first side of the shoe, the pull-tab further comprising a first side of a hook-and-loop fastener on a bottom surface of the elongated substrate of the pull-tab; and a second side of the hook-and-loop fastener on an outer surface of the second side of the shoe.

2. The quick tightening system of claim 1, wherein the aglet channels are separate.

3. The quick tightening system of claim 2, wherein the aglet channels are parallel to each other.

4. The quick tightening system of claim 1, wherein the pull-tab comprises at least one of a protrusion and a depression on the clip cover and at least one of a complementary depression for the protrusion and a complementary protrusion for the depression on the aglet clip engaging with each other at the close position and disengaged from each other at the open position.

5. The quick tightening system of claim 1, further comprising at least one channel wall separating the aglet channels.

6. The quick tightening system of claim 1, further comprising at least two channel walls bordering the at least two aglet channels, wherein each of the at least two channel walls comprises at least one aglet choke extending inward of the at least two channel walls in proximity to each of the aglet openings.

7. The quick tightening system of claim 6, wherein the at least two channel walls comprise at least one retention clip extending above the at least two aglet channels, each retention clip of the at least one retention clip at least partially covering at least one of the at least two aglet channels.

8. The quick tightening system of claim 6, wherein the at least one aglet choke comprises an aglet choke arm extending from a first side of the aglet opening toward a second side of the aglet opening, and extending away from the aglet opening into the aglet channel, the aglet choke arm being fixedly coupled to the first side of the aglet opening and resiliently movable from a rest position to an open position closer to the first side of the aglet opening than in the rest position.

9. The quick tightening system of claim 1, wherein the at least two shoelace segments extend across the tongue and the tongue opening once between passing through the eyelets on the first side of the shoe and passing through the eyelets on the second side of the shoe.

10. The quick tightening system of claim 9, wherein the at least two shoelace segments are joined with one another between the eyelets on the second side of the shoe after extending through the eyelets on the second side of the shoe.

11. The quick tightening system of claim 10, wherein the at least two channel walls comprise at least one retention clip extending above the at least two aglet channels, each retention clip of the at least one retention clip at least partially covering at least one of the at least two aglet channels.

12. The quick tightening system of claim 1, wherein a first strand of the at least two shoelace segments, after passing through a first one of the eyelets on the second side of the shoe, further extends across the tongue and the tongue opening and through a third eyelet on the first side of the shoe, extends across the tongue and the tongue opening and through a third eyelet on the second side of the shoe, and then is joined with other strands of the at least two shoelace segments at a proximity of the third eyelet on the second side of the shoe.

13. The quick tightening system of claim 12, further comprising at least two channel walls bordering the at least two aglet channels, wherein each of the at least two channel walls comprises at least one aglet choke extending inward of the at least two channel walls in proximity to each of the aglet openings.

14. The quick tightening system of claim 13, wherein the at least two channel walls comprise at least one retention clip extending above the at least two aglet channels, each retention clip of the at least one retention clip at least partially covering at least one of the at least two aglet channels.

15. The quick tightening system of claim 1, wherein a first strand of the at least two shoelace segments, after passing through a first one of the eyelets on the second side of the shoe, further passes through a third eyelet on the second side of the shoe, extends across the tongue and the tongue opening and through a third eyelet on the first side of the shoe, and then extends across the tongue and the tongue opening and is joined with other strands of the at least two shoelace segments at a proximity of the first eyelet on the second side of the shoe.

16. The quick tightening system of claim 1, comprising at least two sets of the at least two shoelace segments, the pull-tab, and the second side of the hook-and-loop fastener.

17. The quick tightening system of claim 1, wherein each of the at least two shoelace segments are hollow tubes made of a woven material.

18. The quick tightening system of claim 14, wherein the at least two shoelace segments extend from the aglet channels to the eyelets on the first side of the shoe from a top of the first side of the shoe to a bottom of the first side of the shoe, across the tongue and the tongue opening, and through the eyelets on the second side of the shoe from a top of the second side of the shoe to a bottom of the second side of the shoe.

19. The quick tightening system of claim 1, further comprising a cord shoelace with a first portion of the cord shoelace positioned on the first side of the shoe and a second portion of the cord shoelace positioned on the second side of the shoe, and a tightening wheel on the second side of the shoe tightening or loosening the cord shoelace with turning of the tightening wheel.

20. A quick tightening system for a shoe having a tongue opening, a tongue positioned at the tongue opening, and a first side and a second side divided by the tongue opening, each of the first side and the second side at least partially covering the tongue and including eyelets on portions of the first side and the second side that cover the tongue, the quick tightening system comprising:

at least two shoelace segments each comprising an aglet at a distal end of the shoelace segment, each of the two shoelace segments coupled to the first side of the shoe at a proximal end of the shoelace segment and extending through the eyelets on the first side of the shoe;

a pull-tab comprising an elongated substrate having a length longer than a width and coupled at a first end to an aglet clip comprising at least two aglet channels each having an aglet opening into the aglet clip wherein the aglet channels each enter the aglet clip on a first side of the aglet clip and extend toward a side of the aglet clip different from the first side of the aglet clip, the aglet channels being defined by at least two channel walls each having a majority of the respective wall's length extending in a direction not parallel to the aglet opening for each aglet channel into the aglet clip, wherein the length of each aglet channel is greater than a distance between the at least two channel walls, wherein each of the aglets of the at least two shoelace segments is removably coupled into one of the two aglet channels while the at least two shoelace segments extend from the aglet channels into the eyelets on the first side of the shoe, the pull-tab further comprising a first side of a hook-and-loop fastener on a bottom surface of the elongated substrate of the pull-tab; and a second side of the hook-and-loop fastener on an outer surface of the second side of the shoe.

21. The quick tightening system of claim 20, wherein each of the at least two channel walls comprises at least one aglet choke extending inward of the at least two channel walls in proximity to each of the aglet openings.

22. The quick tightening system of claim 21, wherein the at least one aglet choke comprises an aglet choke arm extending from a first side of the aglet opening toward a second side of the aglet opening, and extending away from the aglet opening into the aglet channel, the aglet choke arm being fixedly coupled to the first side of the aglet opening and resiliently movable from a rest position to an open position closer to the first side of the aglet opening than in the rest position.

23. The quick tightening system of claim 20, wherein the at least two channel walls are parallel to each other.

24. The quick tightening system of claim 20, wherein the aglets of the at least two shoelace segments extend separately through the aglet openings.

25. The quick tightening system of claim 24, wherein the pull-tab further comprises a clip cover, the pull-tab further comprising at least one of a protrusion and a depression on the clip cover and at least one of a complementary depression of the protrusion and a complementary protrusion of the depression on the aglet clip removably engaging with each other.

26. A quick tightening system for a shoe having a tongue opening, a tongue positioned at the tongue opening, and a first side and a second side divided by the tongue opening, each of the first side and the second side at least partially covering the tongue and including eyelets on portions of the first side and the second side that cover the tongue, the quick tightening system comprising:

at least two shoelace segments each comprising an aglet at a distal end of the shoelace segment, each of the two shoelace segments coupled to the first side of the shoe at a proximal end of the shoelace segment and extending through the eyelets on the first side of the shoe;

a pull-tab comprising an elongated substrate and coupled at a first end to an aglet clip comprising at least one aglet channel each having an aglet opening into the aglet clip, each of the aglets is removably coupled into the at least one aglet channel while the at least two shoelace segments extend from the at least one aglet channel and into the eyelets on the first side of the shoe, the pull-tab further comprising a first side of a hook-and-loop fastener on a bottom surface of the substrate of the pull-tab, the at least one aglet channel further comprises at least two channel walls extending from the aglet opening and defining the at least one aglet channel, the length of each aglet channel being greater than a distance between the channel walls, and the aglet channel further comprises at least one aglet choke movably extending inward from at least one of the channel walls and engaging the aglet; and a second side of the hook-and-loop fastener on an outer surface of the second side of the shoe.

27. The quick tightening system of claim 26, wherein the at least one aglet choke comprises an aglet choke arm extending from a first side of the aglet opening toward a second side of the aglet opening, and extending away from the aglet opening into the aglet channel, the aglet choke arm being fixedly coupled to the first side of the aglet opening and resiliently movable from a rest position to an open position closer to the first side of the aglet opening than in the rest position.

28. The quick tightening system of claim 26, wherein the pull-tab further comprises a clip cover, the pull-tab further comprising at least one of a protrusion and a depression on the clip cover and at least one of a complementary depression of the protrusion and a complementary protrusion of the depression on the aglet clip removably engaging with each other.

29. The quick tightening system of claim 26, wherein the channel walls are parallel to each other.

30. The quick tightening system of claim 26, wherein the aglets extend separately through the aglet openings.

* * * * *